US009144254B2

(12) United States Patent
Kerr-Maddox et al.

(10) Patent No.: US 9,144,254 B2
(45) Date of Patent: Sep. 29, 2015

(54) GLOVE WITH INTERIOR GRASPING ELEMENT FOR INVERSION

(75) Inventors: Lisa Kerr-Maddox, Charlotte, NC (US); Daniel Lee Bizzell, Davidson, NC (US)

(73) Assignee: Lisa Kerr-Maddox, Charlotte, NC (US)

( * ) Notice: Subject to any disclaimer, the term of this patent is extended or adjusted under 35 U.S.C. 154(b) by 807 days.

(21) Appl. No.: 13/052,342

(22) Filed: Mar. 21, 2011

(65) Prior Publication Data

US 2011/0167535 A1 Jul. 14, 2011

Related U.S. Application Data

(63) Continuation of application No. 11/383,858, filed on May 17, 2006, now Pat. No. 7,908,673.

(60) Provisional application No. 60/681,753, filed on May 17, 2005.

(51) Int. Cl.
*A41D 19/00* (2006.01)

(52) U.S. Cl.
CPC ..... *A41D 19/0034* (2013.01); *A41D 19/0068* (2013.01); *A41D 19/0075* (2013.01); *A41D 19/0093* (2013.01); *A41D 2400/52* (2013.01); *A41D 2400/70* (2013.01)

(58) Field of Classification Search
USPC ..... 2/161.1, 161.6, 163, 164, 168; 15/227; 294/1.3
See application file for complete search history.

(56) References Cited

U.S. PATENT DOCUMENTS

| | | | | |
|---|---|---|---|---|
| 1,507,707 | A * | 9/1924 | Morganstern | 15/227 |
| 4,752,973 | A * | 6/1988 | Wolfberg et al. | 2/163 |
| 4,902,283 | A * | 2/1990 | Rojko et al. | 604/290 |
| 5,704,670 | A * | 1/1998 | Surplus | 294/25 |
| 6,250,829 | B1 * | 6/2001 | Brower et al. | 401/7 |
| 6,516,469 | B1 * | 2/2003 | Schaetzel | 2/16 |
| 6,611,961 | B2 * | 9/2003 | Demeur et al. | 2/159 |

* cited by examiner

*Primary Examiner* — Katherine Moran
(74) *Attorney, Agent, or Firm* — Tillman Wright, PLLC; Chad D. Tillman; Jeremy C. Doerre

(57) ABSTRACT

An invertible glove includes a hand portion having at least two digit portions configured to cover at least two digits of a hand of a wearer of the glove and a palm portion configured to cover a palm of the hand of the wearer of the glove. The hand portion includes an exterior surface for handling an object and an interior surface for abutting the hand of the wearer of the glove. The hand portion further includes a grasping element that extends from the interior surface of at least one of the digit portions and is configured to be grasped by a digit of the hand of the wearer of the glove for facilitating inversion of the glove when the hand is removed from the glove. A glove is inverted by pulling on the grasping element as the hand is removed from the glove.

15 Claims, 6 Drawing Sheets

GLOVE WITH INTERIOR GRASPING ELEMENT FOR INVERSION

I. CROSS-REFERENCE TO RELATED APPLICATIONS

The present application is a U.S. continuation patent application of, and claims priority under 35 U.S.C. §120 to, U.S. nonprovisional patent application Ser. No. 11/383,858, filed May 17, 2006, which application published as U.S. Patent Application Pub. No. 2006-0260021 on Nov. 23, 2006 and will issue as U.S. Pat. No. 7,908,673 on Mar. 22, 2011, which patent application, patent application publication, and issued patent are each hereby incorporated herein by reference, and which application is a U.S. nonprovisional patent application of, and claims priority under 35 U.S.C. §119(e) to, U.S. provisional patent application Ser. No. 60/681,753, filed May 17, 2005, which provisional patent application is hereby incorporated herein by reference.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND

Plastic, disposable gloves are used in many applications. Such gloves provide a barrier between the hands of the wearer of the glove and whatever the wearer is handling. Because the plastic is generally relatively thin, the gloves do not hinder the wearer's ability to perform the particular task that he or she is performing.

Such gloves may be utilized in a number of activities to prevent contaminants from contacting the hands of a wearer. For example, a person may wear such gloves in culinary activities, such as preparing meat. In addition, a person may wear such gloves in industrial or hobby-craft applications, wherein various hazardous chemicals and materials may be handled.

When using such gloves, it would be advantageous to be able to remove a glove and then don the same glove again without contaminating the environment or the hand of the wearer while doing so. For example, this particular feature would be advantageous when handling raw foods such as meat. A person could don the glove to cut and tenderize the meat, then remove the glove to season the meat with a seasoning dispenser. The person then could re-don the glove to continue handling the meat. In this example, any bacterial or other contaminants that may be present on the meat are kept out of contact with the hands of the wearer and the seasoning dispenser. The person also has avoided excessive waste that otherwise would occur by using a new disposable glove instead of re-donning the old glove.

Once an activity has been completed, a person typically removes and disposes of the glove that was used. During such removal and disposal, the person is generally concerned with preventing contaminants disposed on the external surface of the glove from contacting his or her hands or other objects. Accordingly, it would be advantageous to be able to remove such glove without contaminating the hand of the wearer during removal. It would further be advantageous to be able to prevent contamination of the environment after the glove has been removed.

One or more of these advantages are provided by one or more aspects of the present invention.

IV. SUMMARY OF THE PRESENT INVENTION

The present invention generally relates to an invertible glove and includes many aspects and features.

In a first aspect of the present invention, an invertible glove comprises a hand portion including at least two digit portions configured to cover at least two digits of a hand of a wearer of the glove and a palm portion configured to cover a palm of the hand of the wearer of the glove. The hand portion includes an exterior surface for handling an object and an interior surface for abutting the hand of the wearer of the glove. The hand portion further includes a grasping element that extends from the interior surface and is configured to be grasped by a digit of the hand of the wearer of the glove for facilitating inversion of the glove when the hand is removed from the glove.

In a feature of this aspect, the at least two digit portions consist of a thumb portion for receiving a thumb of the hand of the wearer of the glove and a finger portion for receiving four fingers of the hand of the wearer. In a further feature of this aspect, the at least two digit portions consist of a thumb portion for receiving a thumb of the hand of the wearer of the glove and two finger portions for collectively receiving four fingers of the hand of the wearer. In still yet another feature, the at least two digit portions consist of a thumb portion for receiving a thumb of the hand of the wearer of the glove and three finger portions for collectively receiving four fingers of the hand of the wearer. In an additional feature, the at least two digit portions consist of a thumb portion for receiving a thumb of the hand of the wearer of the glove and four finger portions, each for receiving a respective finger of the hand of the wearer.

In another feature of this aspect, the grasping element comprises a loop. In accordance with this feature, the loop defines an opening that is configured to receive therethrough the end of a digit of the hand of the wearer of the glove. With further regard to this feature, the loop defines an opening that is configured to receive therethrough the end of a finger of the hand of the wearer of the glove. It is preferred that the loop defines an opening that is configured to receive therethrough the end of a thumb of the hand of the wearer of the glove. It is further preferred that the loop defines an opening that is configured to receive therethrough the respective ends of two digits of the hand of the wearer of the glove. In further accordance with this feature, the loop defines an opening that is configured to receive therethrough the respective ends of three digits of the hand of the wearer of the glove. Additionally, the loop defines an opening that is configured to receive therethrough the respective ends of four digits of the hand of the wearer of the glove.

In an additional feature of this aspect, the grasping element is affixed at a seam of the glove and protracts into an interior space enclosed by the hand portion of the glove. In a further feature of this aspect, the grasping element is affixed to the interior surface of the hand portion of the glove in an area configured to abut a volar side of the hand. In another feature of this aspect, the grasping element is affixed to the interior surface of the hand portion of the glove in an area configured to abut a dorsal side of the hand.

In yet another feature of this aspect, the grasping element comprises a tab. In still yet another feature, the grasping element is disposed proximate an end of a digit portion distal to the palm portion.

In a further feature, the hand portion further comprises a second grasping element that extends from the interior surface and is configured to be grasped by one or more digits of the hand thereby facilitating inversion of the glove when the hand is removed from the glove. In an additional feature, the hand portion comprises two planar layers of pliable plastic seamed at outer margins thereof with the glove comprising a disposable glove. In yet another feature, the at least two digit portions define a cleft there between that terminates in an arcuate recess.

In another aspect, a method for inverting a glove comprises providing a glove, which includes a hand portion. The hand portion includes at least two digit portions configured to cover at least two digits of a hand of a wearer of the glove and a palm portion configured to cover a palm of the hand of the wearer of the glove. The hand portion also includes an exterior surface for handling an object and an interior surface for abutting the hand of the wearer of the glove. The hand portion further includes a grasping element that extends from the interior surface and is configured to be grasped by a digit of the hand of the wearer of the glove for facilitating inversion of the glove when the hand is removed from the glove. The method also comprises handling an object having contaminants by engaging the object with the exterior surface of the hand portion. The method further comprises grasping with a digit of the hand on which the glove is worn the grasping element disposed on the interior surface of at least one digit portion of the glove after handling the object and removing the hand from the glove while pulling the grasping element with the digit of the hand such that, when the hand is completely withdrawn from the glove, the glove is inverted and the exterior surface is contained within the glove.

In a feature of this aspect, the method further includes sealing the inverted glove by pressing sealing elements disposed on a forearm portion into interlocking engagement with one another, whereby any contaminants disposed on the exterior surface of the glove are contained within the inverted, sealed glove.

In a further aspect of the present invention, a method for assembling a disposable glove comprises cutting two glove forms from a generally planar sheet of pliable plastic, wherein at least one of the glove forms includes a grasping element; overlaying the two glove forms and seaming the glove forms together along a periphery thereof; and inverting the glove such that the grasping element is disposed within an interior of the glove and extends from an interior surface.

In a feature of this aspect, the method further comprises forming an opening in the grasping element that is configured to receive there through an end portion of a digit of a hand when the glove is donned on the hand.

In another aspect, an invertible glove comprises a hand portion configured to cover a hand of a wearer of the glove, a forearm portion joined with the hand portion, and first and second sealing elements affixed to the forearm portion. When the glove is in a first configuration, the first and second sealing elements bias the forearm portion toward an open position in which the forearm portion defines an opening for receipt of the hand there through in donning of the glove by the wearer, the first and second sealing elements being disposed in surrounding relation to the opening. When the glove is in a second configuration that is inverted relative to the first configuration, the first and second sealing elements are disposed in opposed facing relation to one another and are configured to engage one another in interlocking relation for sealing of the opening defined by the forearm portion.

In a feature of this aspect, the sealing elements comprise a pair of mating sealing strips configured for interlocking engagement with one another. In accordance with this feature, portions of the sealing strips generally are disposed in oppositely facing directions when the glove is in the first configuration. With further regard to this feature, the sealing strips are disposed in opposed relation to one another when the glove is in the second configuration. It is preferred that the sealing strips are disposed in end-to-end disposition relative to one another and, collectively, completely encircle the opening when the glove is in the first configuration.

In another feature of this aspect, the hand portion and forearm portion are formed by two planar layers of pliable plastic that are sealed at outer margins thereof. In accordance with this feature, the sealing elements comprise a pair of mating sealing strips configured for interlocking engagement with one another, each of the sealing strips being attached to a respective planar layer.

In yet another feature of this aspect, each sealing element includes spring-like characteristics.

In a further feature of this aspect, the hand portion comprises at least two digit portions configured to cover at least two digits of a hand of a wearer of the glove, a palm portion configured to cover a palm of the hand of the wearer of the glove, an exterior surface for handling an object, an interior surface for abutting the hand of the wearer of the glove, and a grasping element that extends from the interior surface and is configured to be grasped by a digit of the hand of the wearer of the glove for facilitating inversion of the glove when the hand is removed from the glove.

In another feature of this aspect, the glove further comprises a gripping area disposed proximal a forearm margin for assisting in donning and removing the glove. In accordance with this feature, the gripping area defines an opening therein.

In another aspect, a method for inverting a glove after repeated use comprises providing a glove including a hand portion configured to cover a hand of a wearer of the glove, a forearm portion joined with the hand portion, and first and second sealing elements affixed to the forearm portion. When the glove is in a first configuration, the first and second sealing elements bias the forearm portion toward an open position in which the forearm portion defines an opening for receipt of the hand there through in donning of the glove by the wearer with the first and second sealing elements being disposed in surrounding relation to the opening. When the glove is in a second configuration that is inverted relative to the first configuration, the first and second sealing elements are disposed in opposed facing relation to one another and are configured to engage one another in interlocking relation for sealing of the opening defined by the forearm portion. The method further comprises donning the glove by inserting a hand through the opening defined by the forearm portion when the glove is in the first configuration with the first and second sealing elements biasing the forearm portion toward the open position for insertion of the hand; handling an object having contaminants by engaging the object with the exterior surface of the hand portion; and removing the hand from the glove when the glove is in the first configuration with the first and second sealing elements biasing the forearm portion toward the open position for withdrawal of the hand. The method further comprises re-donning the glove by inserting the hand through the opening defined by the forearm portion when the glove is in the first configuration with the first and second sealing elements biasing the forearm portion toward the open position; removing the hand from the glove such that, when the hand is completely withdrawn from the glove, the glove is inverted and the exterior surface is contained within the glove; and sealing the inverted glove by pressing the sealing elements disposed on the forearm portion into interlocking engagement with one another, whereby any contaminants disposed on the exterior surface of the glove are contained within the inverted, sealed glove.

In a feature of this aspect, the method further comprises the step of grasping, with a digit of the hand on which the glove is worn, a grasping element that is disposed on the interior surface of a digit portion of the glove while removing the hand from the glove.

In yet another aspect, a method for making a disposable glove comprises cutting two glove forms from a generally planar sheet of pliable plastic; overlaying the two glove forms and seaming the glove forms together along a periphery thereof; and inverting the glove such that a first sealing element of the first glove form and a second sealing element of the second glove form bias the glove into an open configuration defining an opening for receiving there through a hand for donning of the glove.

In a feature of this aspect, the method further comprises the steps of affixing the first and second sealing elements respectively to the first and second glove forms prior to seaming of the glove forms together. In accordance with this feature, the first and second sealing elements comprise first and second sealing strips disposed in end-to-end relation.

In another feature of this aspect, the method further comprises the steps of affixing the first and second sealing elements respectively to the first and second glove forms after the seaming of the glove forms together. In yet another feature, the method further comprises forming a grasping element in each of the glove forms such that, when the glove is inverted, the grasping element is disposed within an interior of the glove and extends from an interior surface. In accordance with the feature, the method further comprises forming an opening in the grasping element that is configured to receive there through an end portion of a digit of a hand when the glove is donned on the hand. In accordance with this feature, the method further comprises forming a second grasping element in one of the glove forms such that, when the glove is inverted, the second grasping element is disposed within an interior of the glove and extends from an interior surface.

V. BRIEF DESCRIPTION OF THE DRAWINGS

One or more embodiments of the present invention will be described in detail with reference to the accompanying drawings which are briefly described below, wherein the same elements are referred to with the same reference numerals, and wherein various elements are not necessarily shown in conformance to any particular absolute or relative scale.

VI. DETAILED DESCRIPTION

Figure 1:
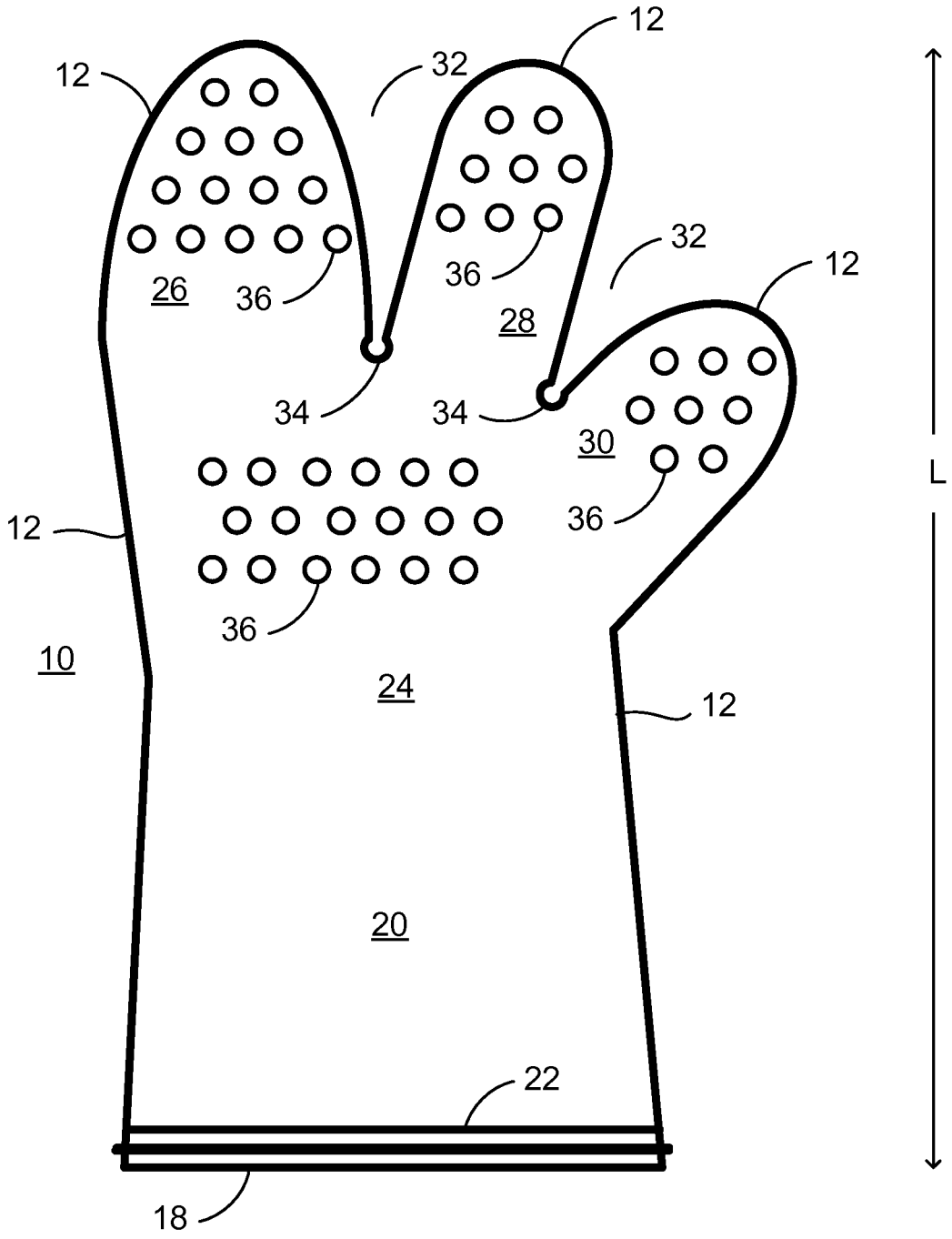
FIG. 1 is a plan view of a glove according to an embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Additionally, as used herein, "glove" means a covering for at least the hand and wrist and that includes one or more finger portions sheathing the four fingers of the hand, a thumb portion sheathing the thumb of the hand, and a palm portion sheathing the remainder of the hand including the palm.

Turning now to the figures, a glove 10 according to a preferred embodiment of the present invention is shown in FIG. 1. The glove 10 is formed of two generally planar layers of pliable plastic, such as 4 mil polyethylene, joined in a unitary construction. Additional suitable plastics may include polyvinyl chloride, nylon, or other plastics with similar characteristics. Exemplary plastics are available from Eastman Chemical Company under the trade names PROVISTA copolymer, ALL AMERICAN POLY 2100, and ALL AMERICAN POLY 3000. Biodegradable plastics may also be utilized. An exemplary biodegradable plastic is available from Eastman Chemical Company under the trade name EASTAR BIO. The two layers are seamed together along outer margins 12 by plastic welding, fusing, bonding, sewing, or adhesive attachment to form seams of approximately one eighth of an inch thickness. Forearm margins 18 are not seamed, however, and provide an opening for insertion and removal of a hand into the glove 10. The layers when seamed together along outer margins 12 form two sides of the glove 10, with one side covering volar surfaces of a hand and the other side covering dorsal surfaces of the hand of a wearer when the glove 10 is donned.

In addition, when the layers of the glove 10 have been seamed, the glove 10 includes an interior surface 14, which contacts the hand of a wearer when the glove 10 is worn, and an exterior surface 16, which may contact external environmental contaminants while the glove 10 is worn. The glove 10 includes forearm margins 18 disposed at a perimeter of a forearm portion 20 and a pair 22 of sealing-strips 22*a*,22*b* disposed on the exterior surface 16 of opposite sides of the glove 10 proximal the forearm margin 18. The glove 10 may be transparent or opaque. Moreover, the glove 10 may be any desired color.

In this embodiment, the glove 10 includes a hand portion. The hand portion includes a palm portion 24, a first finger portion 26, a second finger portion 28, and a thumb portion 30. Whereas fingers and thumbs are collectively referred to as digits, the first finger portion 26, the second finger portion 28 and the thumb portion 30 may also be referred to as digit portions. As such, the present embodiment of the glove 10 comprises three digit portions.

When the glove 10 is donned, the first finger portion 26 receives three fingers, the second finger portion 28 receives an index finger, and the thumb portion 30 receives a thumb. Clefts 32 defined between adjacent finger portions 26,28 and the thumb portion 30 terminate in arcuate recesses 34 that facilitate motion of the fingers while minimizing tearing of the glove material.

Optionally, portions of the glove 10 are textured to facilitate gripping of objects while wearing the glove 10. For example, in FIG. 1, raised bumps or protuberances 36, formed by embossing, are provided on the finger portions 26,28 thumb portion 30, and palm portion 24. In other embodiments, other textured patterns are formed by other techniques such as, for example, by entraining an abrasive substance into the material of the glove 10 or by attaching abrasive pads to desired areas of the glove 10.

The embodiment of the inventive glove 10 of FIG. 1 is configured to cover the human hand and a substantial portion of the human forearm. For example, insofar as the glove 10 is dimensioned to receive an adult hand, the overall length "L" of the glove 10 preferably is about thirteen inches. Such length provides an optional gripping area 42 (shown in FIG. 7) at the terminus of the glove 10 to assist in donning, removing, or inverting of the glove 10 without contacting contaminants disposed on portions of the glove, such as the finger portions 26,28, thumb portion 30, and palm portion 24, all of which may have been used to handle such contaminants.

Additionally, the glove 10 of FIG. 1 preferably is a left-handed glove. Alternatively, both sides of the glove 10 may include the same features, in which case the glove 10 may be used with either the left hand or right hand.

Figure 2A:
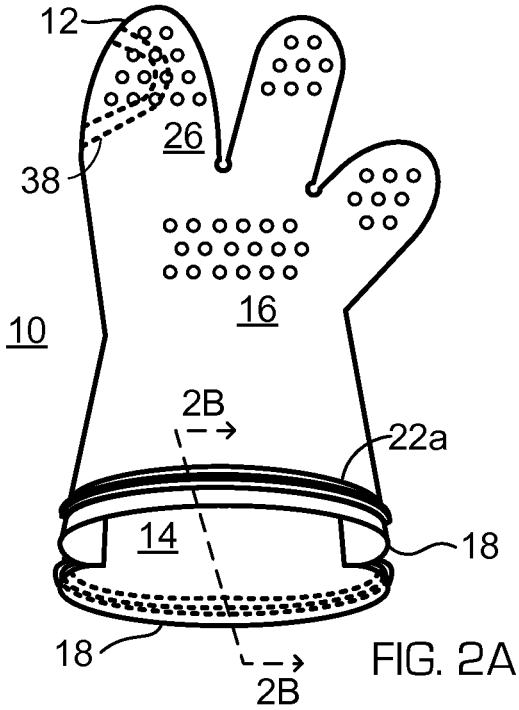
FIG. 2A is a perspective view of the glove of FIG. 1.
Figure 2B:
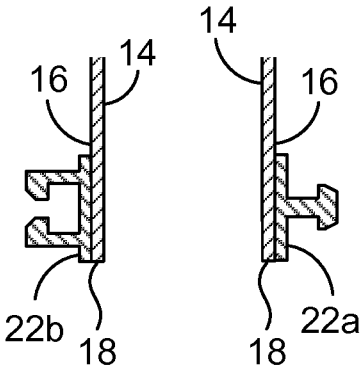
FIG. 2B is a partial cross-sectional view of the glove of FIG. 2A taken along the line 2B-2B in FIG. 2A.

Further features of the inventive glove 10 are shown in FIGS. 2A-B and 3A-3C. In FIGS. 2A-2B, the forearm margins 18 of the glove 10 are biased in an open position to allow for convenient passage of a hand in donning and removing the glove 10. The forearm margins 18 of the glove 10 are biased open by the flexible but semi-rigid sealing strips 22*a*,22*b* attached to the exterior surface 16 of the opposite sides of the glove 10. The flexible but semi-rigid construction of the sealing strips 22*a*,22*b* gives them spring-like characteristics. Exemplary sealing strips are available from Zip-Pak under the trade names EASY-STOMP zipper, POWDER PROOF zipper, ZIP-PAK RETORT zipper, ATL-140 zipper, and PERF CAP zipper tape. Additional exemplary sealing strips are available from other manufacturers under the trade names EZ-ALIGN zipper, which has multiple interlocking profiles; the ONE-TIME LOCKING zipper, which closes but does not reopen; the DEGRADABLE zipper; the SURLYN compatible zipper; and Barrier INNO-LOK—a combination of Zip-Pak's barrier zipper with Hudson-Sharp's INNO-LOK technology.

As will be apparent from the foregoing description, the glove 10 can be donned, used in activities that tend to contaminate the exterior surface 16 of the glove 10, removed, re-donned, and used again. A benefit of reuse of the glove 10 is that waste can be minimized since only one glove 10 is required for each hand during a given activity.

For example, the glove 10 may be used in culinary activities. In preparing a meal, an amateur or professional chef can: firstly, don and use the glove 10 in handling and cutting meat; secondly, remove the glove 10 to handle a spice dispenser and sprinkle spices on the cut meat; and thirdly, with particular regard to the forearm margins 18 of the glove 10 being biased open, don the glove for further use. Note this can be accomplished without contaminating the spice dispenser (not shown) and the interior surface 14 of the glove 10 because of the open-biased position of the forearm margins 18. Thus the glove 10 is useful to prevent the contamination of a kitchen environment with blood, fluids and debris that potentially contain food-poisoning agents such as salmonella organisms. Furthermore, as the glove 10 can be reused before disposal, waste is minimized to serve the interests of those environmentally concerned and those concerned about the costs of gloves.

The glove 10 also can be used in many industrial and hobby-craft applications. For example, the glove 10 can be used to avoid contaminating a work environment with a chemical and can be used to avoid cross-contaminating chemical resources. Minimizing waste by using the inventive glove 10 can be particularly poignant in activities where waste materials must be managed with care or expense. For example, gloves, brushes, and rags contaminated with oils and epoxies can represent a fire hazard, consequently, waste thereof should be minimized and carefully managed. In another example, disposing of gloves contaminated with hazardous materials—such as biological agents and radioactive materials—requires special handling and expense, and thus waste thereof should be minimized.

Figure 3A:
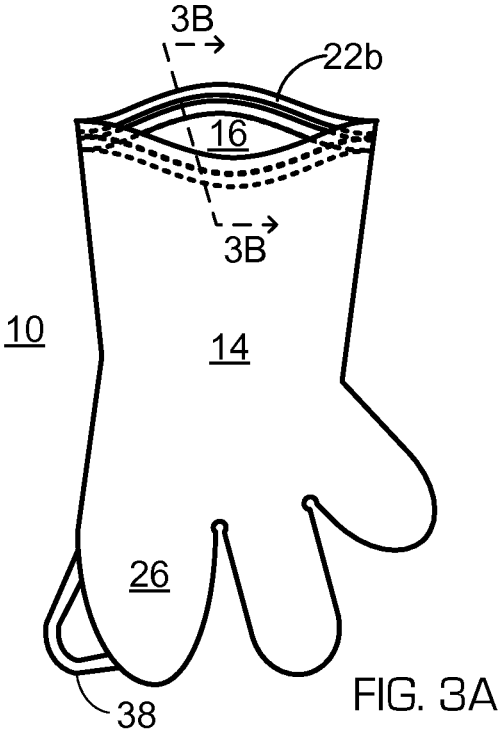
FIG. 3A is a perspective view of the glove of FIG. 2A in an inverted configuration (inside-out).
Figure 3B:
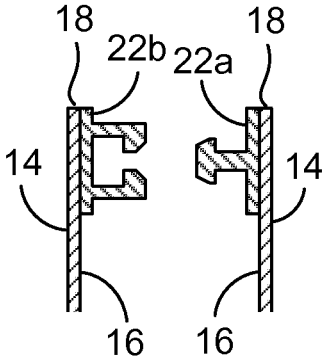
FIG. 3B is a partial cross-sectional view of the glove of FIG. 3A taken along the line 3B-3B in FIG. 3A.
Figure 3C:
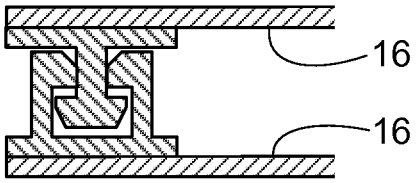
FIG. 3C is a view of sealing strips of the glove of FIG. 3B, wherein the sealing strips are in sealing engagement.

In FIGS. 3A-3C, the glove 10 is shown inverted, that is, turned inside-out such that the interior surface 14 of the glove 10 of FIGS. 2A-2B is exposed to the surrounding environment. When inverted, the sealing strips 22*a*,22*b* are disposed in opposed facing relation to each other, as shown in FIG. 3B, and are thereby capable of sealing engagement, as shown in FIG. 3C. Specifically, the sealing strips 22*a*,22*b* preferably are pressed into engagement with one another along entire lengths thereof for sealing of the inverted glove 10. When the sealing strips 22*a*,22*b* are sealed as shown in FIG. 3C, any contaminants collected on the exterior surface 16 of the glove 10 during use are thereby contained within the inverted, sealed glove 10. The glove 10 can then be safely disposed in a trash container with concerns regarding contamination and odors being alleviated by the sealing of the inverted glove 10.

As shown in FIGS. 2A and 3A, a grasping element 38 depends from the interior surface 14 of the glove 10. The grasping element 38 is provided to facilitate inversion of the glove 10. After donning and using the glove 10, the wearer, in inverting the glove 10, conveniently grasps the grasping element 38 with one or more fingers disposed within the glove 10 and withdraws the hand from the glove 10. The grasping element 38 preferably includes a loop attached to a seam of the glove 10 within the first finger portion 26. Insofar as the glove 10 is formed of two generally planar layers of pliable plastic—such as 4 mil polyethylene—seamed along outer margins 12 thereof, the grasping element 38 may be formed as a bi-layer comprising portions of the planar layers. Alternatively, the grasping element 38 may be formed as a single layer comprising a portion of only one of the planar layers. In other embodiments, the grasping element 38 comprises a tab for grasping and pulling for inverting the glove.

Figure 4:
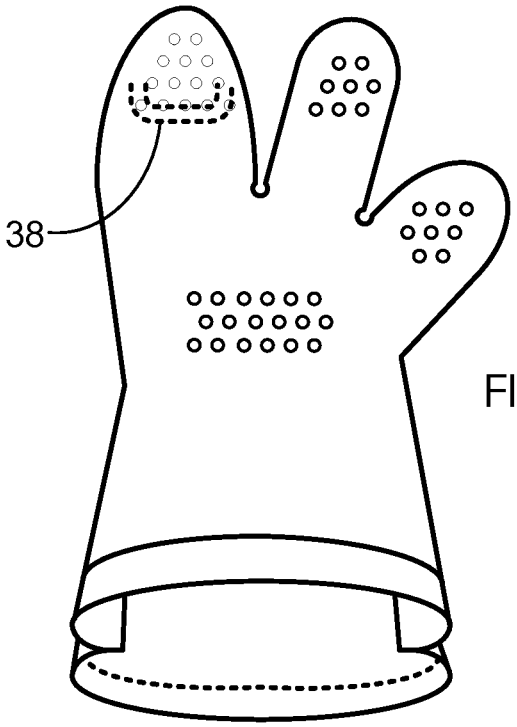
FIG. 4 is a perspective view of a glove according to another embodiment of the present invention.
Figure 5:
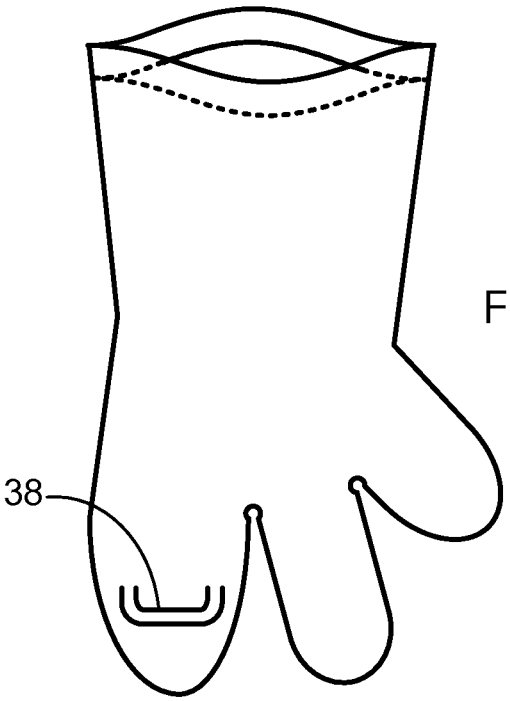
FIG. 5 is a perspective view of the glove of FIG. 4 in an inverted configuration (inside-out).
Figure 6:
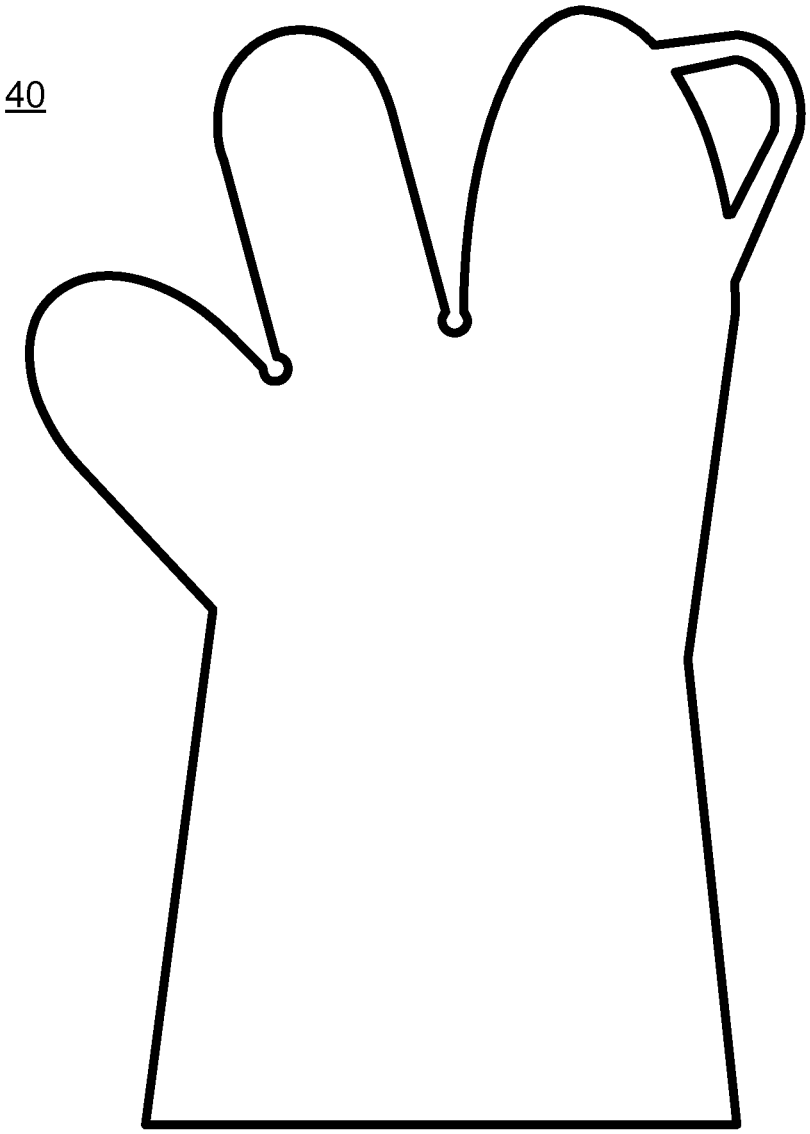
FIG. 6 is a view of a glove form used to make the glove of FIG. 1.

Yet another alternative of the grasping element 38 is shown in FIGS. 4-5, wherein the grasping element 38 is attached to the interior surface of the first finger portion 26 of the glove 10 and does not extend from a seam of the glove 10. Such embodiment is shown biased open in FIG. 4 and inverted in FIG. 5. The glove 10 may further include a second grasping element (not shown) depending from the interior surface 14 of another digit portion of the glove 10 to facilitate further the inversion of the glove 10. Though the glove 10 may be manufactured by many techniques, an exemplary method comprises cutting or stamping a glove form 40, which includes a grasping element 38, from a generally planar layer of pliable plastic. Two such glove forms 40 are then overlaid and heat-seamed together. The steps of cutting and heat-seaming may be combined. Sealing strips 22*a*,22*b* may be attached to the glove forms 40 before or after heat-seaming the two forms 40 together. According to the exemplary method, the glove 10 is thereby first manufactured in the configuration shown in FIG. 3A, i.e., in an inverted configuration. The glove 10 is then turned "outside-in" for use in the configuration shown in FIG. 2A.

In operation, the glove 10 of the present invention may be easily donned because the forearm margins 18 are biased into an open position by the pair of sealing strips 22. A person wishing to wear the glove 10 simply slips his or her hand into the glove 10 such that the fingers of the hand of the wearer are disposed within the finger portions 26,28 and the thumb of the wearer is disposed within the thumb portion 30. If the wearer wishes to remove the glove 10 temporarily, the wearer simply pulls the hand out of the glove 10 and places the glove 10 in a suitable holding location. For example, a wearer preparing meat may wish to remove the hand from the glove 10 temporarily to season the meat thereby avoiding contaminating the spice dispenser. While the meat is being seasoned, the glove 10 may be placed in a sink. After the meat has been seasoned, the wearer may easily re-don the glove 10 without contaminating the still-clean hand because the forearm margins 18 of the glove 10 are biased open.

If the wearer wishes to remove the glove 10 permanently and dispose of the glove 10, the grasping element 38 is grasped with one or more of the fingers and pulled as the hand is removed from the glove 10. The grasping element 38 thus facilitates inversion of the glove 10 during removal of the hand, and once the hand has been removed, the glove 10 will be inverted. When the glove 10 is inverted, the pair of sealing strips 22 then are pressed into sealing engagement to contain any contaminants within the sealed, inverted glove 10. The sealed, inverted glove 10 then may be disposed of without concern for subsequent environmental contamination.

Figure 7:
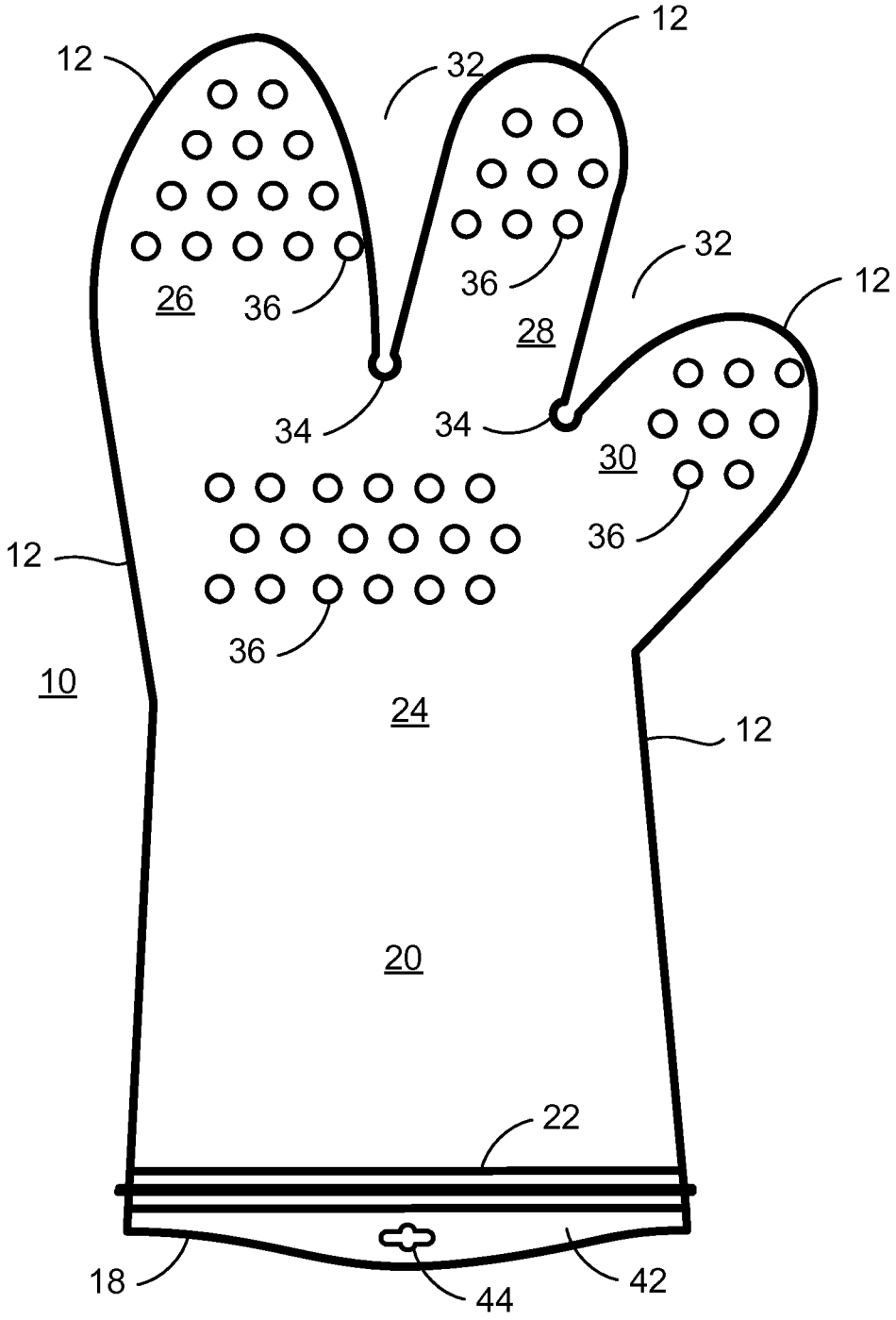
FIG. 7 is a plan view of a glove according to yet another embodiment of the present invention.

The glove optionally may include a gripping area 42 that extends from the sealing strips 22*a*,22*b* away from the fingers, thumb, and palm portions of the glove 10. This alternative embodiment is illustrated in FIG. 7. While inverting the glove 10 by withdrawing the hand and pulling the grasping element 38, the wearer additionally may hold the gripping area 42 with a free hand to further facilitate removal of the hand and inversion of the glove 10. Because the gripping area 42 extends from the sealing strips 22*a*,22*b* away from the hand portion of the glove 10, the gripping area 42 is unlikely to have contaminants on the exterior surface thereof. Moreover, additional care can be exercised by the wearer to avoid contamination of the gripping area, as necessary.

If a gripping area 42 is provided, then a hang tab cutout 44 may be defined therein whereby the glove 10 may be hung from a hook during storage or when displayed for sale. Such a cutout further may be utilized both when simply removing a hand from a glove 10 as well as when inverting a glove, especially if both hands are gloved. In this respect, a hook or other protuberance can be used, in conjunction with the cutout, in removing a hand from a glove 10. The hook or other protuberance can be extended through the cutout and used as an anchor point when removing the hand.

The descriptions herein thus far have been provided generally without recitation of dimensions of the inventive glove 10 and the accompanying drawings are generally presented without particular regard to any absolute or relative scale beyond that inherent in the human hand and forearm. Insofar as the human hand takes various particular shapes and sizes, the inventive glove 10 conforms to various shapes and sizes. Accordingly, the inventive glove 10 can be made available: as a "one size fits all" garment; in size ranges such as small, medium, and large; in men's and women's respective sizes; in children's and adult's respective sizes; and, in any indexed assortment of sizes and shapes. Furthermore, though the embodiments of the inventive glove 10 shown in the accompanying drawings are illustrated to include exactly two finger portions 26,28 with the thumb portion 30, other embodiments include other numbers of finger portions. For example, in one embodiment, the inventive glove includes a finger portion for each finger of the human hand such that the glove is formed as a four-finger glove with a thumb portion. As such, this embodiment includes five digit portions. In another embodiment, the glove includes a single finger portion for four fingers such that the glove is formed as a mitten, with one finger portion and a thumb portion. Accordingly, the mitten embodiment includes two digit portions.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An invertible glove, comprising:

(a) a hand portion including, (i) at least two digit portions configured to cover at least two digits of a hand of a wearer of the glove, and (ii) a palm portion configured to cover a palm of the hand of the wearer of the glove;

(b) wherein the hand portion includes first and second layers of the same pliable material joined in a unitary construction, (i) the first layer defining a first outermost exterior surface and a first innermost interior surface of the hand portion, and (ii) the second layer defining a second outermost exterior surface and a second innermost interior surface of the hand portion, the first and second outermost exterior surfaces defining an entire outermost exterior surface of the hand portion of the glove, and the first and second innermost interior surfaces defining an entire innermost interior surface of the hand portion of the glove for abutting the hand of the wearer of the glove;

(c) wherein the hand portion further includes a grasping element that extends from the hand portion and is configured to be grasped and pulled by a digit of the hand of the wearer of the glove for facilitating inversion of the glove when the hand is removed from the glove; and (d) wherein the grasping element and at least one of the first and second layers of the pliable material of the hand portion are unitarily constructed in a one-piece construction such that there is no seam between the grasping element and the at least one of the first and second layers, the grasping element comprising a portion of the at least one of the first and second layers of the pliable material of the hand portion.

2. A glove, comprising:

(a) a hand portion including first and second layers of pliable material that are joined to define, (i) at least two digit portions configured to cover at least two digits of a hand of a wearer of the glove, (ii) a palm portion configured to cover a palm of the hand of the wearer of the glove, and (iii) a grasping element that extends from an interior surface of the hand portion and that is configured to be grasped and pulled by a digit of the hand of the wearer of the glove for facilitating inversion of the glove when the hand is removed from the glove;

(b) wherein the grasping element and at least one of the first and second layers of the pliable material of the hand portion are unitarily constructed, the grasping element comprising a portion of the at least one of the first and second layers of the pliable material of the hand portion;

(c) wherein the glove further comprises a forearm portion joined with the hand portion, the forearm portion including first and second sealing elements having spring-like characteristics such that, (i) when the glove is in a first configuration, the first and second sealing elements bias the forearm portion toward an open position in which the forearm portion defines an opening for receipt of the hand there through in donning of the glove by the wearer, the first and second sealing elements being disposed in surrounding relation to the opening, and (ii) when the glove is in a second configuration that is inverted relative to the first configuration, the first and second sealing elements are disposed in opposed facing relation to one another and are configured to engage one another in interlocking relation for sealing of the opening defined by the forearm portion.

3. The glove of claim 2, wherein the first layer defines a first outermost exterior surface and a first innermost interior surface of the hand portion; and the second layer defines a second outermost exterior surface and a second innermost interior surface of the hand portion, the first and second outermost exterior surfaces defining an entire outermost exterior surface of the hand portion of the glove, and the first and second innermost interior surfaces defining an entire innermost interior surface of the hand portion of the glove for abutting the hand of the wearer of the glove.

4. The glove of claim 2, wherein the at least two digit portions comprise of a thumb portion for receiving a thumb of the hand of the wearer of the glove and at least one finger portion for receiving a plurality of fingers of the hand of the wearer.

5. The glove of claim 2, wherein the grasping element comprises a tab.

6. The glove of claim 2, wherein the grasping element defines an opening that is configured to receive therethrough the end of a digit of the hand of the wearer of the glove.

7. The glove of claim 2, wherein the grasping element defines an opening that is configured to receive therethrough the respective ends of a plurality of digits of the hand of the wearer of the glove.

8. The glove of claim 2, wherein the grasping element comprises an elongate member having first and second opposite ends, each opposite end located at a seam of the glove.

9. The glove of claim 2, wherein the grasping element defines a loop and is located at an interior surface of the hand portion of the glove in an area configured to abut a volar side of the hand when the glove is donned.

10. The glove of claim 2, wherein the grasping element defines a loop and is located at an interior surface of the hand portion of the glove in an area configured to abut a dorsal side of the hand when the glove is donned.

11. The glove of claim 2, wherein the grasping element is disposed proximate an end of a digit portion distal to the palm portion and extends only adjacent the digit portion.

12. The glove of claim 2, wherein the first and second sealing elements comprise a pair of mating sealing strips configured for interlocking engagement with one another.

13. The glove of claim 2, wherein the forearm portion is formed from the two layers of pliable material of the hand portion.

14. The glove of claim 13, wherein each of the sealing elements comprises a pair of mating sealing strips configured for interlocking engagement with one another, each of the sealing strips being attached to a respective one of the layers of pliable material of the forearm portion.

15. A glove, comprising:

(a) a hand portion including first and second layers of pliable material that are joined to define, (i) at least two digit portions configured to cover at least two digits of a hand of a wearer of the glove, (ii) a palm portion configured to cover a palm of the hand of the wearer of the glove, and (iii) a grasping element that extends from an interior surface of the hand portion and that is configured to be grasped and pulled by a digit of the hand of the wearer of the glove for facilitating inversion of the glove when the hand is removed from the glove;

(b) wherein the grasping element and at least one of the first and second layers of the pliable material of the hand portion are unitarily constructed, the grasping element comprising a portion of the at least one of the first and second layers of the pliable material of the hand portion;

(c) wherein the first and second layers of the hand portion define, between at least two digit portions, a cleft that terminates in an arcuate recess.

* * * * *